US007638470B2

(12) United States Patent
Coke et al.

(10) Patent No.: US 7,638,470 B2
(45) Date of Patent: Dec. 29, 2009

(54) CLEANING

(75) Inventors: Mark Coke, East Lothian (GB); Paul John Duffield, Hull (GB); Malcolm Tom McKechnie, Hull (GB); Jane Warwick, Hull (GB); Matthew White, Harston (GB); James Young, Hull (GB)

(73) Assignee: Reckitt Benckiser (UK) Limited, Slough,Berkshire (GB)

( * ) Notice: Subject to any disclaimer, the term of this patent is extended or adjusted under 35 U.S.C. 154(b) by 171 days.

(21) Appl. No.: 11/572,361

(22) PCT Filed: Jul. 18, 2005

(86) PCT No.: PCT/GB2005/002806

§ 371 (c)(1),
(2), (4) Date: Feb. 14, 2007

(87) PCT Pub. No.: WO2006/010889

PCT Pub. Date: Feb. 2, 2006

(65) Prior Publication Data

US 2007/0254824 A1 Nov. 1, 2007

(30) Foreign Application Priority Data

Jul. 24, 2004 (GB) ..... 0416560.1

(51) Int. Cl.
*C11D 3/395* (2006.01)

(52) U.S. Cl. ..... 510/109; 510/372; 510/310; 510/308; 510/302; 510/276

(58) Field of Classification Search ..... 510/109, 510/224, 294, 298, 406, 438
See application file for complete search history.

(56) References Cited

U.S. PATENT DOCUMENTS

| | | | | |
|---|---|---|---|---|
| 3,632,516 | A * | 1/1972 | Antonelli et al. | 510/372 |
| 4,137,361 | A * | 1/1979 | Deffeyes et al. | 428/328 |
| 4,447,704 | A | 5/1984 | Suzuki et al. | |
| 4,539,132 | A * | 9/1985 | Oakes | 510/306 |
| 4,618,444 | A | 10/1986 | Hudson et al. | |
| 4,626,374 | A | 12/1986 | Finch et al. | |
| 4,755,354 | A | 7/1988 | Trinh et al. | |
| 4,780,152 | A * | 10/1988 | Itagaki et al. | 134/42 |
| 4,810,410 | A * | 3/1989 | Diakun et al. | 8/111 |
| 5,041,232 | A | 8/1991 | Batal et al. | |
| 5,047,163 | A | 9/1991 | Batal et al. | |
| 5,324,131 | A * | 6/1994 | Gardner, III | 401/199 |
| 5,611,687 | A * | 3/1997 | Wagner | 433/80 |
| 6,440,396 | B1 * | 8/2002 | McLaughlin | 424/49 |
| 6,699,828 | B1 * | 3/2004 | de Buzzaccarini et al. | 510/372 |
| 6,846,332 | B2 * | 1/2005 | Boissie et al. | 8/111 |
| 2002/0151451 | A1 * | 10/2002 | Barnabas et al. | 510/392 |
| 2002/0178511 | A1 * | 12/2002 | Goldoni et al. | 8/158 |
| 2003/0070692 | A1 * | 4/2003 | Smith et al. | 134/6 |
| 2004/0072710 | A1 * | 4/2004 | McKechnie et al. | 510/302 |
| 2004/0147423 | A1 * | 7/2004 | Scialla et al. | 510/372 |
| 2007/0077213 | A1 * | 4/2007 | McLaughlin | 424/53 |
| 2007/0254824 | A1 * | 11/2007 | Coke et al. | 510/406 |

FOREIGN PATENT DOCUMENTS

| | | | |
|---|---|---|---|
| EP | 0257942 | A1 | 3/1988 |
| EP | 458397 | A2 | 11/1991 |
| GB | 869742 | A | 6/1961 |
| WO | 02/06434 | A | 1/2002 |

OTHER PUBLICATIONS

International Search Report dated Sep. 26, 2005 for application PCT/GB2005/002806.
Written Opinion of the International Searching Authority for application PCT/GB2005/002806.
Search Report issued by the Patent Office in Great Britain for application GB0416560.1 and dated Dec. 1, 2004.
Kirk-Othmer, Encyclopedia of Chemical Technology, 3rd Ed., vol. 22, pp. 346-387.

* cited by examiner

*Primary Examiner*—Mark Eashoo
*Assistant Examiner*—M. Reza Asdjodi
(74) *Attorney, Agent, or Firm*—Norris McLaughlin & Marcus, PA

(57) ABSTRACT

A liquid cleaning composition and a solid state catalyst are provided in combination. The solid state catalyst causes a chemical reaction in the liquid cleaning composition, when the liquid cleaning composition is brought into contact with it. The chemical reaction may increase the oxidising power of the liquid cleaning composition, or change its pH, or cause gas evolution, or release heat.

32 Claims, No Drawings

CLEANING

This is an application filed under 35 USC 371 of PCT/GB2005/002806.

This invention relates to improvements in or relating to cleaning, in particular, but not exclusively, to improvements in the cleaning of bodies, for example hard surfaces and fabrics.

One problem with existing cleaning compositions is that their cleaning performance can be modest against certain soils. It is known that especially tenacious soils include red wine, turmeric and blood.

One effective method of tackling tenacious stains on fabrics is to soak them in a pre-treatment composition, for example a dispersion of sodium percarbonate, before the fabrics are machine washed. That dispersion is formed shortly before use by mixing a powder formulation of sodium percarbonate, together with a bleach activator, into water, in order to decompose the sodium percarbonate.

This method is effective and successful but it is not suitable for all situations; and it may be inconvenient for people to make up a treatment solution and apply it to a soil as an extra step in a laundering process.

Furthermore, it is known that different soils need different cleaning treatments for optimal effectiveness. For example, greasy soils are typically dealt with most effectively by alkaline cleaning compositions; limescale is most effectively dealt with by acidic cleaning compositions; and so on. Thus, bathroom cleaners are often acidic compositions, intended to combat calcium deposits. On the other hand, kitchen cleaners are often alkaline compositions, intended to combat grease deposits. However, there are situations in which for bathroom cleaning, an alkaline composition would be desirable; and in which for kitchen cleaning, an acidic cleaning composition would be desirable.

Accordingly the consumer has to decide whether to purchase a plethora of different products for different cleaning tasks, or whether to compromise. It would be of benefit to have a single cleaning composition which has a good level of effectiveness against more than one soil type.

It is an object of embodiments of the present invention to provide cleaning technology which offers some advantage over the methods described above.

In accordance with a first aspect of the present invention there is provided a cleaning combination comprising a liquid cleaning composition and a solid state catalyst separate from the liquid cleaning composition, the solid state catalyst causing a chemical reaction in the liquid cleaning composition when the liquid cleaning composition is brought into contact with the solid state catalyst.

The word "cleaning" in this specification includes within its meaning soil removal, soil bleaching, and the prevention of soil deposition. By "soil" we include all undesired deposits and stains, including populations of microorganisms. "Cleaning" in this specification also includes sanitizing (including killing and inhibiting undesired viruses and microorganisms, including bacteria, and combating allergens, especially Der-p and Der-f dust mite allergens).

The chemical reaction may be a decomposition of a component of the liquid cleaning composition, catalysed by the solid state catalyst. Alternatively the chemical reaction may be a reaction between two components of the liquid cleaning composition, catalysed by the solid state catalyst. Alternatively the chemical reaction may be a reaction between a component of the liquid cleaning composition and a species present in the environment of use, for example oxygen or water, this reaction being catalysed by the solid state catalyst.

Alternatively the chemical reaction may be a reaction with a second liquid cleaning composition, part of the cleaning combination but separate from the liquid cleaning composition until use of the cleaning combination, this reaction being catalysed by the solid state catalyst. In this embodiment the solid state catalyst may be separate from the second liquid cleaning composition until use or it may be in contact therewith.

The solid state catalyst may be of a type to catalyse each molecular event of the chemical reaction. Preferably, however, the catalyst is of a type to initiate the chemical reaction, which may then continue, and preferably escalate. The chemical reaction may then continue even in the absence of the solid state catalyst. For example in the case of an exothermic reaction the heat produced may promote the continuation of the reaction.

Percentage values of components expressed in this specification are expressed as % wt of a component/wt of composition, unless stated otherwise.

By "liquid" herein we mean flowable under normal use conditions. Thus "liquid" may include a lotion or cream.

By solid state catalyst, we mean a catalyst which is comprised by a body. The catalyst may be retained on the surface of the body; it may be comprised within the material of the body; or the material of the body may itself be catalytic.

The solid state catalyst may be comprised by the body permanently or semi-permanently. By semi-permanently, we mean that the catalyst species may progressively separate from the body during repeated phases of operation, in which the liquid cleaning composition is brought into contact with the solid state catalyst. In such an embodiment the body preferably comprises a catalytically effective amount of catalyst throughout the intended life. For example, when a catalyst is semi-permanently retained on a cleaning cloth, there should still be a catalytically effective amount of catalyst on the cloth at the end of the cloth's useful life. As another example, when the solid state catalyst is located in an exit pathway of a trigger spray pump device, there should be a catalytically effective amount of catalyst present when the device is exhausted of its liquid cleaning composition.

The liquid cleaning composition is preferably a ready-to-use composition, not requiring the addition of water or any other material, and is stable until it is used, when it is brought into contact with the solid state catalyst.

In preferred embodiments of the invention the cleaning is achieved against a soil already present at the locus of treatment.

The body which comprises the catalyst could in certain embodiments be a particulate body, for example of siliceous grains or polymeric beads. Preferably, however, the body is a non-particulate body. Preferably a non-particulate body is a monolithic body.

Preferably, the combination is such that, in a cleaning operation, the liquid cleaning composition is in contact with, for example flows over or through, the solid state catalyst. To this end the solid state catalyst may be retained in a fixed position, in a device which preferably also contains the liquid cleaning composition. Preferably the solid state catalyst is downstream of the liquid cleaning composition, and the liquid cleaning composition is in contact with the solid state catalyst as it exits the device.

Preferably, the solid state catalyst is one in which the catalyst is permanently retained on the surface of a body by a surface treatment, without being compounded within the material of the body.

Embodiments are not ruled out, however, in which a catalyst is present throughout the body, having been incorporated into its material during its manufacture. For example a catalyst could be incorporated into a polymeric material or a glass or ceramic material. It could be incorporated into a block which has multiple pores or flow paths therethrough; for example an open-celled foam material.

The body may be loaded with the catalyst in a conventional manner, for example by chemical reaction onto the body; or with the aid of a chemical anchoring agent, having an affinity for the body and the catalyst (for example a layer of a chelating agent); or by means of an adhesive or a binder which is unaffected by the liquid cleaning composition; or by sputtering, or by firing or calcination, in case of glass or ceramic bodies; or by electrostatic powder coating; or by anodizing; or by plasma treatment. Preferably the method is one in which a body is formed and then modified in its surface chemistry, to retain the catalyst.

Of course the manner in which the solid state catalyst is formed depends on the material of the body and the nature of the catalyst. The formation of solid state catalysts is an extensive art and it is not necessary in this specification to draw from it extensively, and go beyond the guidance given above.

The body could, for example, be a polymeric (including elastomeric, and including foamed), glass or ceramic material, or could be of wood, metal or stone. It could be a textile material.

In some embodiments the body may be such as to permit flow-through of the liquid cleaning composition. For example the body may comprise a single through-bore. It may comprise a plurality of through-bores. It may comprise a multiplicity of capillary passageways.

When the body is a textile material it may suitably be a fabric, for example a cleaning cloth, wipe, item of clothing or upholstery item. The fabric could be woven but is preferably non-woven. Alternatively the textile material may comprise a fibre wad or block, preferably of fibres in a compressed form.

The textile material may comprise natural fibres, preferably cotton. Preferably, the textile material comprises synthetic polymer fibres (preferably polypropylene). In especially preferred embodiments the textile material consists of synthetic polymer fibres, or consists of synthetic polymer fibres together with natural fibres.

A catalyst retained on a textile material (to form a solid state catalyst) is able to react with a component in the liquid cleaning composition in order to generate a beneficial cleaning effect. For example this may happen in a bucket or bowl during window cleaning or floor mopping. Alternatively the chemical reaction could occur during a fabric washing operation.

In another embodiment the solid state catalyst is a catalytically-modified cleaning cloth, fibre, wad, pad or sponge.

In another embodiment the body comprising the catalyst may be placed in a fabric washing machine. The body could be a textile or sponge body or a hard plastics body. The body could be provided inside a cage permitting flow-through of wash liquor in order to prevent direct contact between the catalyst and the fabrics being washed.

In another embodiment the body comprising the catalyst may be a part which pierces the wall of a container, when cleaning is to be carried out. In such an embodiment such a container may be purchased as a replacement item. It may suitably be mounted onto a handle which is provided with the piercing part. Once the wall of the container has been pierced the liquid cleaning composition, activated by the catalyst, can flow or seep into an absorbent part, for example a sponge or pad, which functions as a cleaning head. Such an embodiment may be useful, for example, for oven cleaning.

In one embodiment the intention is to effect a chemical reaction in a liquid cleaning composition in a bucket or bowl, or the like. In another embodiment the cleaning cloth, fibre, wad, pad or sponge may be an applicator. For example it could be the applicator for a laundry "pen" or shoe cleaning product, the liquid cleaning composition being delivered to the cleaning locus through a sponge.

In other embodiments the catalyst may be carried by a body which is ordinarily present at a cleaning locus. For example, a sanitaryware item or a window may have a surface preloaded with catalyst, in situ or in manufacture, and when a liquid cleaning composition is brought into contact with it, a chemical reaction is induced. The locus could be treated with a catalyst as part of its manufacture or it could be modified in situ by the user, provided with the catalyst in the suitable application medium, together with instructions for its application.

In preferred embodiments, however, the cleaning combination is provided in a common device which contains the liquid cleaning composition and the solid state catalyst, the liquid cleaning composition coming into contact with the solid state catalyst preferably only during exiting of the liquid cleaning composition from the device.

The device may be an aerosol spray device. It may be a manually-operated pump device. It may be a finger spray device. Most preferably it is a trigger spray device. By trigger spray device we mean a device in which a spray is caused to issue from the device by application of hand pressure to a lever.

In such spray devices there may be a store of the liquid cleaning composition and a dip tube extending into it, and there are downstream passageways which are isolated from the liquid cleaning composition until operation of the device. For example in the case of a trigger spray device there is typically a piston and cylinder arrangement for creating the pressure differential which urges the liquid cleaning composition up the dip tube and, downstream of the piston and cylinder, a series of passageways which include a swirl chamber just before the outlet nozzle. In the swirl chamber the liquid cleaning composition is swirled in a plane orthogonal to the direction in which the liquid cleaning composition is conveyed by the piston and cylinder, and also orthogonal to the direction in which fluid exits from the nozzle. The purpose of the swirl chamber is to improve the spray pattern. In an especially preferred embodiment of the invention which employs a trigger spray device the solid state catalyst is comprised within the trigger spray head. Most preferably the internal surfaces of the swirl chamber are provided with the solid state catalyst.

As noted above, the device may also be a device with an applicator head, being said body, through which the liquid cleaning composition is delivered onto a locus (preferably a surface) to be cleaned. The device may, for example, be in the form of a pen, or a reservoir capped with a pad, or a roller device; in each case preferably designed such that the reservoir of liquid cleaning composition is kept isolated from the solid state catalyst until it is expelled from the device. In some embodiments there may be an isolator chamber and/or one-way valve arrangement, adjacent to the applicator head. For example the container may be in the form of a squeezable main chamber leading via a one-way valve to an isolation chamber, in communication with the applicator head. The action of squeezing the main chamber urges the liquid cleaning composition into the isolation chamber. The catalytic action may commence in the isolation chamber or may commence when the liquid chemical composition issues from the applicator head. The one-way valve may suitably be an elastomeric valve of the sphincter type.

When there is a second liquid chemical composition the device preferably comprises two chambers and two applicator means. The two liquid chemical compositions could mix within the device, preferably immediately before issuance from the device. Alternatively the two liquid chemical compositions could mix only downstream of the device, at least one of them having been exposed to the catalyst on egress, and thereby having a component primed for reaction with a component of the other liquid chemical composition.

The chemical reaction caused when the liquid cleaning composition is brought into contact with the solid state catalyst is preferably any change which is of benefit in cleaning.

In one embodiment the chemical reaction is to release a bleaching agent. The bleaching agent could be a chlorine-containing bleaching agent but is preferably an active oxygen bleaching agent.

Exemplary chlorine-containing bleach materials useful in the liquid cleaning compositions include alkali metal hypochlorites, chloroisocyanuric acids and N-chloro compounds usually containing an organic radical. N-chloro compounds are usually characterized by a double bond on the atom adjacent to a trivalent nitrogen and a chlorine (Cl+) attached to the nitrogen which readily exchanges with H+ or M+ (where M+ is a common metal ion such as Na+, K+, etc.), so as to release HOCl or OCl— on hydrolysis.

Preferred alkali metal hypochlorite compounds useful in the liquid cleaning compositions herein include sodium hypochlorite, potassium hypochlorite, and lithium hypochlorite as well as calcium hypochlorite and magnesium hypochlorite. Suitable catalysts therefore include copper and cobalt salts, for example cobalt (III) nitrate, which causes decomposition of hypochlorite with oxygen evolution. This leads to the possibility of having foaming and bleaching compositions.

Preferred chlorine bleach materials useful in the liquid cleaning compositions herein are chloroisocyanuric acids and alkali metal salts thereof, preferably potassium, and especially sodium salts thereof. Examples of such compounds include trichloroisocyanuric acid, dichloroisocyanuric acid, sodium dichloroisocyanurate, potassium dichloroisocyanurate, and trichloro-potassium dichloroisocyanurate complex.

Preferred N-chloro compounds useful as chlorine bleach materials in the liquid cleaning compositions include trichlorolisocyanuric acid, dichloroisocyanuric acid, monochloroisocyanuric acid, 1,3-dichloro-5,5-dimethylhydantoin, 1-chloro-5,5-dimethylhydantoin, N-chlorosuccinimide, N-chlorosulphamate, N-chloro-p-nitroacetanilide, N-chloro-o-nitroacetanilide, N-chloro-m-nitroacetanilide, N-m-dichloroacetanilide, N-p-dichloroacetanilide, Dichloramine-T, N-chloro-propionanilide, N-chlorobutyranilide, N-chloroacetanilide, N-o-dichloroacetanilide, N-chloro-p-acetotoluide, N-chloro-m-acetotoluide, N-chloroformanilide, N-chloro-o-acetotoluide, Chloramine-T, ammonia monochloramine, albuminoid chloramines, N-chlorosulphamide, Chloramine B, Dichloramine B, di-halo(bromochlorodimethylhydantoin), N,N'-dichlorobenzoylene urea, p-toluene sulphodichloroamide, trichloromelamine, N-chloroammeline, N,N'-dichloroazodicarbonamide, N-chloroacetyl urea, N,N'-dichlorobiuret, chlorinated dicyandiamide, and alkali metal salts of the above acids, and stable hydrates of the above compounds.

Preferably the liquid cleaning composition contains a precursor compound for the release of active oxygen.

Preferably the precursor compound is a particulate material dispersed in the liquid cleaning composition or, more preferably, is soluble in the liquid cleaning composition, and is dissolved in it.

Inorganic peroxygen-generating compounds may be used as bleaching compounds in the liquid cleaning composition of the present invention. Examples include salts of monopersulfate, perborate monohydrate, perborate tetrahydrate, and percarbonate, especially alkali metal salts, preferably sodium salts.

Other possible materials include monoperoxy acids, including alkyl peroxy acids and aryl peroxy acids such as peroxy benzoic acid and ring-substituted peroxy benzoic acids (e.g. peroxy-alpha-naphthoic acid); aliphatic and substituted aliphatic monoperoxy acids (e.g. peroxylauric acid and peroxystearic acid); and phthaloyl amido peroxy caproic acid (pap). Suitable diperoxy acids include alkyl diperoxy acids and aryl diperoxy acids.

Especially preferred as an active oxygen bleaching agent is hydrogen peroxide.

The catalyst with such systems may suitably be selected from transition metals and transition metal compounds, including manganese, manganese compounds (including manganese dioxide and manganese complexes such as Mn-Me TACN, as described in EP-A-458397), sodium molybdate, ammonium molybdate, iron II or iron III salts (e.g. halides), platinum, vanadium and copper II salts. Further suitable catalysts may include cobalt salts and sulfonimines as described in U.S. Pat. Nos. 5,041,232 and 5,047,163.

Further catalysts include polyoxometalates, of which examples are as follows:

$Na_{10}[Mn_3W(SbW_9O_{34})_2]$, $Na_{12}[ZnMn_2W(ZnW_9O_{34})_2]$, $Na_8[MnZnW_{11}O_{39}]$, $Na_6[(MnSiW_{11}O_{39}]$, $Na_8[Mn_2SiW_{10}O_{38}]$, $Na_{10}[(Mn_3SiW_9O_{37}]$, $Na_9[(Mn_3PW_9O_{37}]$.

Useful catalysts may include enzymes, which may be immobilised by adsorption, covalent binding, entrapment and membrane confinement.

When a liquid cleaning composition used in the present invention contains an active oxygen bleaching agent, it preferably comprises no more than 20% by weight of the active oxygen bleaching agent, more preferably no more than 15%, more preferably no more than 12%, still more preferably no more than 10%, for example, no more than 8%. Suitably, it comprises at least 0.1% by weight of the active oxygen bleaching agent, more preferably at least 0.5%, more preferably at least 1%, still more preferably at least 2%, more preferably at least 4% and most preferably at least 6%.

In one embodiment the chemical reaction causes a change in pH.

In one embodiment the chemical reaction causes a colour change. This may be of benefit in providing the consumer with a visual indication that cleaning is taking place, or has finished. For example the cleaning combination may apply a coloured composition to a locus to be cleaned, with the colour disappearing under catalytic action, after an appropriate cleaning interval.

In one embodiment the chemical reaction causes gas evolution. This may be of benefit in causing agitation at the locus of cleaning. It may be of benefit in providing the consumer with a visual sign that cleaning is taking place. The gas evolution may be such as to cause foaming. The foaming may be of further benefit in promoting retention of the cleaning composition on the surface being cleaned.

In one embodiment the chemical reaction causes the evolution of heat. This may be of benefit in many cleaning solutions, for example in cleaning greasy surfaces or surfaces carrying limescale.

Some chemical systems may exhibit more than one of these changes. For example an active oxygen bleaching agent may, in addition to releasing active oxygen, exhibit a pH change and the evolution of heat. A pH-responsive colour change agent may be present, to change colour as a consequence of the pH change.

The chemical reaction may occur substantially immediately when the liquid chemical composition contacts the solid state catalyst but it is preferred that the chemical reaction extends over a longer period, of for example at least 10 seconds, preferably at least 30 seconds. Preferably it extends up to 10 minutes, more preferably up to 5 minutes. A chemical reaction extending over such a period may be achieved, for example, when the solid state catalyst starts a reaction which proceeds even in its absence. Alternatively or additionally it may be achieved, for example, when the solid state catalyst is retained only semi-permanently, so that a proportion detaches and remains in contact with the liquid chemical composition.

Preferably a liquid cleaning composition of the present invention is an aqueous composition. Preferably it contains at least 50% water, more preferably at least 70%, and most preferably at least 85%.

In accordance with a second aspect of the present invention there is provided, in combination, a liquid cleaning composition containing a peroxygen compound and a solid state catalyst, the solid state catalyst causing the release of active oxygen species in the liquid cleaning composition when the liquid cleaning composition is brought into contact with the solid state catalyst.

In a third aspect of the present invention there is provided a cleaning device which comprises a container for the liquid cleaning composition and a solid state catalyst, the liquid cleaning composition contacting the solid state catalyst only during exiting of the liquid cleaning composition from the device.

In accordance with a fourth aspect of the present invention there is provided a body comprising a solid state catalyst, the catalyst being capable of causing a chemical reaction in a liquid cleaning composition which is brought in contact with it.

In accordance with a fifth aspect of the present invention there is provided a method of chemically modifying a liquid cleaning composition by contacting it during cleaning with a body as defined and described above.

In accordance with a sixth aspect of the present invention there is provided a method of cleaning comprising delivering a liquid cleaning composition to a locus to be cleaned, wherein the liquid cleaning composition contacts a body as defined and described above during the method.

The second, third, fourth, fifth or sixth aspects of the present invention may be further defined by the appropriate further definitions given above in relation to the first aspect.

A liquid cleaning composition as defined in relation to any aspect of the present invention may contain one or more compounds conventionally employed in liquid cleaning compositions. Such components should be selected so as not to prevent the interaction of the liquid cleaning composition with the solid state catalyst.

In preferred embodiments the cleaning composition liquid, for example a composition comprising at least an organic solvent or at least one surfactant, may include one or more further agents, e.g., thickeners, polishes, abrasive agent, bleaches, enzymes or anti-microbial, for example anti-bacterial, agents.

A liquid cleaning composition desirably includes at least one surfactant selected from anionic, cationic, non-ionic or amphoteric (zwitterionic) surfactants.

Examples of anionic surfactants which may be used as or in the cleaning composition include but are not limited to: alkali metal salts, ammonium salts, amine salts, aminoalcohol salts or the magnesium salts of one or more of the following compounds: alkyl sulphates, alkyl ether sulphates, alkylamidoether sulphates, alkylaryl polyether sulphates, monoglyceride sulphates, alkylsulphonates, alkylamide sulphonates, alkylarylsulphonates, olefinsulphonates, paraffin sulphonates, alkyl sulphosuccinates, alkyl ether sulphosuccinates, alkylamide sulphosuccinates, alkyl sulphosuccinamate, alkyl sulphoacetates, alkyl phosphates, alkyl ether phosphates, acyl sarconsinates, acyl isothionates and N-acyl taurates. Generally, the alkyl or acyl group in these various compounds comprises a carbon chain containing 12 to 20 carbon atoms.

Other anionic surfactants which may be used include fatty acid salts, including salts of oleic, ricinoleic, palmitic and stearic acids; copra oils or hydrogenated copra oil acid, and acyl lactylates whose acyl group contains 8 to 20 carbon atoms.

One class of nonionic surfactants which may be used as or in the cleaning composition are alkoxylated alcohols, particularly alkoxylated fatty alcohols. These include ethoxylated and propoxylated fatty alcohols, as well as ethoxylated and propoxylated alkyl phenols, preferably having alkyl groups of from 7 to 16, more preferably 8 to 13 carbon chains in length.

Examples of alkoxylated alcohols include certain ethoxylated alcohol compositions presently commercially available from the Shell Company, (Houston, Tex.) under the general trade name NEODOL™, which are described to be linear alcohol ethoxylates and certain compositions presently commercially available from the Union Carbide Company, (Danbury, Conn.) under the general trade name TERGITOL (trade mark), which are described to be secondary alcohol ethoxylates.

Examples of alkoxylated alkyl phenols include certain compositions presently commercially available from the Rhône-Poulenc Company (Cranbury, N.J.) under the general trade name IGEPAL (trade mark), which are described to be octyl and nonyl phenols.

A further class of non-ionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amines, amides, phenols, and secondary alcohols.

One group of nonionic surfactants containing the characteristic alkylene oxide blocks are those which may be generally represented by the formula (A):

$$HO—(EO)_x(PO)_y(EO)_z—H \quad (A)$$

where

EO represents ethylene oxy,

PO represents propylene oxy, y equals at least 15, $(EO)_{x+z}$ equals 20 to 50% of the total weight of said compounds, and, the total molecular weight is preferably in the range of about 2000 to 15,000.

Another group of nonionic surfactants appropriate for use can be represented by the formula (B):

$$R—(EO,PO)_a(EO,PO)_b—H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000. Still further useful nonionic surfactants containing polymeric butoxy (BO) groups can be represented by formula (C) as follows:

$$RO—(BO)_n(EO)_x—H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO—(EO)_x(BO)_n(EO)_y—H \quad (D)$$

wherein n is about 15, x is about 15 and y is about 15.

Still further useful nonionic block copolymer surfactants include ethoxylated derivatives of propoxylated ethylene diamine, which may be represented by the following formula:

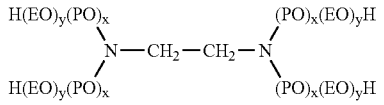

(E)

where (EO) represents ethylene oxy, (PO) represents propylene oxy, the amount of $(PO)_x$ is such as to provide a molecular weight prior to ethoxylation of about 300 to 7500, and the amount of $(EO)_y$ is such as to provide about 20% to 90% of the total weight of said compound.

Another class of non-ionic surfactants that may be used are sorbitan esters of fatty acids, typically of fatty acids having from 10 to 24 carbon atoms, for example sorbitan mono oleate.

A further class of non-ionic surfactants which may be used include amine oxides. Exemplary amine oxide compounds include those which may be defined as one or more of the following four general classes:

(A) Alkyl di (lower alkyl) amine oxides in which the alkyl group has about 6-24, and preferably 8-18 carbon atoms, and can be straight or branched chain, saturated or unsaturated. The lower alkyl groups includes between 1 and 7 carbon atoms, but preferably each include 1 to 3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(B) Alkyl di (hydroxy lower alkyl) amine oxides in which the alkyl group has about 6-22, and preferably 8-18 carbon atoms, and can be straight or branched chain, saturated or unsaturated. Examples include bis-(2-hydroxyethyl) cocoamine oxide, bis-(2-hydroxyethyl) tallow amine oxide; and bis-(2-hydroxyethyl) stearylamine oxide;

(C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallow amidopropyl dimethyl amine oxide; and (D) Alkylmorpholine oxides in which the alkyl group has about 10-20, and preferably 12-16 carbon atoms, and can be straight or branched chain, saturated or unsaturated.

A further class of non-ionic surfactants include those presently marketed under the trade name PLURONIC™. The compounds are formed by condensing ethylene oxide with a hydrophobic base formed by the condensation of propylene oxide with propylene glycol, and are described by their manufacturer to have the following general structure:

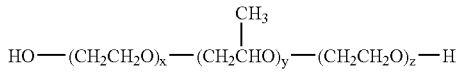

wherein x, y and z are selected such that the molecular weight of the block polymers varies from at least about 1,000 to about 15,000 and the polyethylene oxide content may comprise 5% to 90% by weight of the block polymer.

Amphoteric surfactants which may be used in the present invention include amphoteric betaine surfactant compounds having the following general formula:

$$R—N^+(R_1)_2—R_2COO^-$$

wherein R is a hydrophobic group which is an alkyl group containing from 10 to 22 carbon atoms, preferably from 12 to 18 carbon atoms, an alkylaryl or arylalkyl group containing a similar number of carbon atoms with a benzene ring being treated as equivalent to about 2 carbon atoms, and similar structures interrupted by amido or ether linkages; each $R_1$ is an alkyl group containing from 1 to 3 carbon atoms; and $R_2$ is an alkylene group containing from 1 to 6 carbon atoms.

Further exemplary useful amphoteric surfactants include those selected from alkylampho(mono)- and (di)-acetates, alkylampho(mono)- and (di)-propionates, and aminopropionates. These amphoteric surfactants may be used singly, or in combination with further other amphoteric surfactants, but desirably are the sole amphoteric surfactants present in the compositions. Salt forms of these amphoteric surfactants may also be used. Exemplary alkylampho(mono)acetates include those according to the general structure:

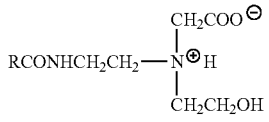

wherein R represents a C8 to C24 alkyl chain; alkylampho (di)acetates according to either of the general structures:

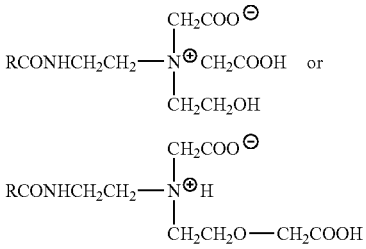

wherein R represents a C8 to C24 alkyl chain; alkylampho (mono)propionates according to the according to the general structure:

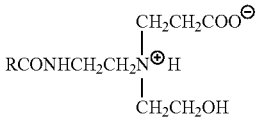

wherein R represents a C8 to C24 alkyl chain; alkylampho (di)propionates according to either of the general structures:

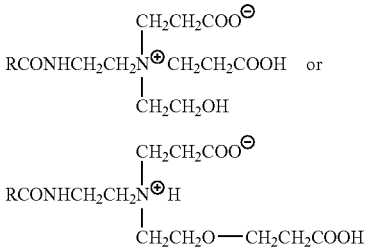

wherein R represents a C8 to C24 alkyl chain; aminopropionates according to the following general structure:

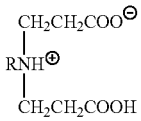

wherein R represents a C8 to C24 alkyl chain. In each of the above indicated structures, R represents a $C_8$-$C_{24}$ alkyl group and desirably is a $C_{10}$-$C_{16}$ alkyl group, especially derived from soy or coconut the latter of which typically provides a mixture of $C_{8-10}$, $C_{12}$, $C_{14}$ and $C_{16}$ alkyl groups.

Examples of cationic surfactants which may be used include quaternary ammonium compounds and salts thereof, including quaternary ammonium compounds which also have germicidal activity and which may be characterized by the general structural formula:

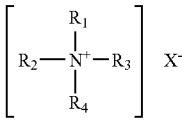

when at least one of $R_1$, $R_2$, $R_3$ and $R_4$ is a hydrophobic, aliphatic, aryl aliphatic or aliphatic aryl group containing from 6 to 26 carbon atoms, and the entire cationic portion of the molecule has a molecular weight of at least 165. The hydrophobic groups may be long-chain alkyl, long-chain alkoxy aryl, long-chain alkyl aryl, halogen-substituted long-chain alkyl aryl, long-chain alkyl phenoxy alkyl or aryl alkyl. The remaining groups on the nitrogen atoms, other than the hydrophobic radicals, are generally hydrocarbon groups usually containing a total of no more than 12 carbon atoms. The radicals $R_1$, $R_2$, $R_3$ and $R_4$ may be straight chain or may be branched, but are preferably straight chain, and may include one or more amide or ester linkages. The radical X may be any salt-forming anionic radical.

Examples of quaternary ammonium salts within the above description include the alkyl ammonium halides such as cetyl trimethyl ammonium bromide, alkyl aryl ammonium halides such as octadecyl dimethyl benzyl ammonium bromide, and N-alkyl pyridinium halides such as N-cetyl pyridinium bromide. Other suitable types of quaternary ammonium salts include those in which the molecule contains either amide or ester linkages, such as octyl phenoxy ethoxy ethyl dimethyl benzyl ammonium chloride and N-(laurylcocoaminoformylmethyl)-pyridinium chloride. Other effective types of quaternary ammonium compounds which are useful as germicides includes those in which the hydrophobic radical is characterized by a substituted aromatic nucleus as in the case of lauryloxyphenyltrimethyl ammonium chloride, cetylaminophenyltrimethyl ammonium methosulphate, dodecylphenyltrimethyl ammonium methosulphate, dodecylphenyltrimethyl ammonium chloride and chlorinated dodecylphenyltrimethyl ammonium chloride.

Preferred quaternary ammonium compounds are those which act as anti-microbial agents particularly those which have the structural formula:

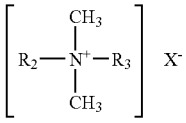

wherein $R_2$ and $R_3$ are the same or different $C_8$-$C_{12}$ alkyl group, or $R_2$ is $C_{12}$-$C_{16}$ alkyl, $C_8$-$C_{18}$ alkylethoxy, $C_8$-$C_{18}$ alkyl-phenolethoxy and $R_2$ is benzyl, and X is a halide, for example chloride, bromide or iodide, or is methosulphate. The alkyl groups $R_2$ and $R_3$ may be straight chain or branched, but are preferably substantially linear.

Other known surfactants not particularly described above may also be used. Such surfactants are described in McCutcheon's Detergents and Emulsifiers, North American Edition, 1982; Kirk-Othmer, Encyclopaedia of Chemical Technology, 3rd Ed., Vol. 22, pp 346-387.

A cleaning composition may include one or more solvents to improve soil removal, selected for example, from lower alkyl monohydric alcohols, lower alkyl polyhydric alcohols, lower alkyl diols and glycol ethers, having the general structure Ra—O—Rb—OH, wherein Ra is an alkyl of 1 to 20 carbon atoms, or an aryl of at least 6 carbon atoms, and Rb is an alkylene of 1 to 8 carbons; or an ether or polyether containing from 2 to 20 carbon atoms; or a compound of formula $A(OR)_n$ where A represents a carbon backbone moiety, n is at least 2 and each group R represents a hydrogen atom or an alkyl or polyether group containing from 1 to 20 carbon atoms, provided that at least one group R represents a said alkyl or polyether group. Preferred are glycol ethers having one to five glycol monomer units. Examples of more preferred solvents include methanol, ethanol, all isomeric forms of propanol, all isomeric forms of butanol, propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof.

The surfactants and/or solvents may be included in the cleaning composition in any effective amount. Preferably the surfactants and/or solvents comprise from 0.01-50 weight percent, preferably 0.01-30 weight percent of the cleaning composition, with the balance to 100 weight percent comprising water and any further optional constituents.

A cleaning composition described above may also include one or more further constituents, for example selected from: perfumes and fragrances, additional agents for improving soil removal and wetting and surface characteristics (fluorosurfactants), film-forming agents, bleach, pH buffering agents, pH adjusting agents, preservatives, anti-microbial agents, descalers, viscosity modifiers (thickeners), grease-cutting agents (alkanolamines) foamers, defoamers, carriers, colourants, hydrotropes, preservatives, anti-oxidants, anti-corrosion agents, polishes and optical brighteners.

Fluorosurfactants may be included in the liquid cleaning compositions to improve the cleaning function, especially the surface wetting of surfaces treated by the article. Exemplary fluorocarbon surfactants include the anionic salts of perfluoroaliphaticoxybenzene sulphonic acids and the anionic salts of linear perfluoroalkyl-oxybenzoic acids. Examples of the former class of fluorocarbon surfactants can be represented by the following formula:

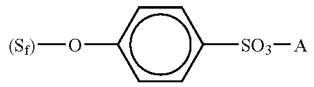

where $R_f$ is a perfluoroaliphatic group of from about 5 to about 15 carbon atoms, preferably from about 8 to 12 carbon atoms in the aliphatic group which may be an alkyl group or alkenyl group, and A is a cation such as an alkali metal, ammonium or amine.

Examples of the latter class of fluorocarbon surfactants can be represented by the formula:

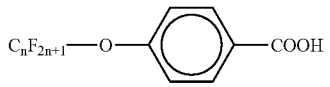

wherein n is a number of from about 2 to about 16 and m is a number from about 3 to about 34.

Other suitable fluorocarbon surfactants include:

(a) $R_fCH_2CH_2SCH_2CO_2M$ wherein $R_f$ is $F(CF_2CF_2)_n$ and n is from about 3 to about 8 and M is alkali metal (e.g., sodium or potassium) or ammonium;

(b) $C_nF_{2n+1}SO_3M$ wherein $C_nF_{2n+1}$ is a straight chain fluorocarbon radical, n is from about 8 to about 12 and M is alkali metal or ammonium;

(c) $C_nF_{2n+1}SO_3M$ wherein $C_nF_{2n+1}$ is a straight chain fluorocarbon radical, n is from about 8 to about 12 and M is an alkali metal cation;

(d) $R_fCH_2CH_2O(CH_2CH_2O)_nH$ wherein $R_f$ is a straight chain $F(CF_2CF_2)_n$ radical and n is from about 3 to about 8;

(e) $R_f(OCH_2CH_2)_nOR_f$ wherein $R_f$ is a branched chain radical of the formula $C_8F_{15+}C_{10}F_{19}$ or $C_{12}F_{23}$ and n is from about 10 to about 30; and (f) $R_f(OCH_2CH_2)_mOR$ wherein $R_f$ is a branched chain radical of the formula $C_8F_{15+}C_{10}F_{19}$ or $C_{12}F_{23}$, m is from about 2 to about 20 and R is $C_1$ to $C_3$ alkyl.

Fluorinated hydrocarbon surfactants are available from numerous commercial sources as trademarked products. Examples are ZONYL (trade mark) fluorosurfactants, FLUORAD (trade mark) fluorosurfactants, e.g., FLUORAD FC-129 ($R_fSO_2N(C_2H_5)CH_2CO_2^-K^+$, where $R_f$ is $C_nF_{2n+1}$ and n is about 8), and MONOFLOR (trade mark) fluorocarbon.

Exemplary useful film forming agents include, e.g., partially esterified resins described in U.S. Pat. No. 4,447,704.

Exemplary preservatives which may form part of the liquid cleaning compositions include useful water soluble or water dispersible compositions which include parabens, including methyl parabens and ethyl parabens, glutaraldehyde, formaldehyde, 2-bromo-2-nitropropane-1,3-diol, 5-chloro-2-methyl-4-isothiazolin-3-one, 2-methyl-4-isothiazoline-3-one, and mixtures thereof.

A liquid cleaning composition used herein may include further anti-microbially affective agents, e.g., pyrithiones (especially zinc pyrithione which is also known as ZPT), dimethyldimethylol hydantoin (Glydant), methylchloroisothiazolinone/methylisothiazolinone (Kathon CG), sodium sulphite, sodium bisulphite, imidazolidinyl urea (Germall 115), diazolidinyl urea (Germaill II), benzyl alcohol, 2-bromo-2-nitropropane-1,3-diol (Bronopol), formalin (formaldehyde), iodopropenyl butylcarbamate (Polyphase P100), chloroacetamide, methanamine, methyldibromonitrile glutaronitrile (1,2-Dibromo-2,4-dicyanobutane or Tektamer), glutaraldehyde, 5-bromo-5-nitro-1,3-dioxane (Bronidox), phenethyl alcohol, o-phenylphenol/sodium o-phenylphenol, sodium hydroxymethylglycinate (Suttocide A), polymethoxy bicyclic oxazolidine (Nuosept C), dimethoxane, thimersal dichlorobenzyl alcohol, captan, chlorphenenesin, dichlorophene, chlorbutanol, glyceryl laurate, halogenated diphenyl ethers like 2,4,4-trichloro-2-hydroxydiphenyl ether (Triclosan or TCS), 2,2-dihydroxy-5,5-dibromo-diphenyl ether, phenolic compounds like phenol, 2-methyl phenol, 3-methyl phenol, 4-methyl phenol, 4-ethyl phenol, 2,4-dimethyl phenol, 2,5-dimethylphenol, 3,4-dimethyl phenol, 2,6-dimethyl phenol, 4-n-propyl phenol, 4-n-butyl phenol, 4-n-amyl phenol, 4-tert-amyl phenol, 4-n-hexyl phenol, 4-n-heptyl phenol, mono- and poly-alkyl and aromatic halophenols such as p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-isopropyl-3-methyl p-chlorophenol, 2-ethyl-3,5-dimethyl p-chlorophenol, 6-sec-butyl-3-methyl p-chlorophenol,2-isopropyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m, m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, 5-chloro-2-hydroxydiphenylmethane, resorcinol and its derivatives including methyl resorcinol, ethyl resorcinol, n-propyl resorcinol, n-butyl resorcinol, n-amyl resorcinol, n-hexyl resorcinol, n-heptyl resorcinol, n-octyl resorcinol, n-nonyl resorcinol, phenyl resorcinol, benzyl resorcinol, phenylethyl resorcinol, phenylpropyl resorcinol, p-chlorobenzyl resorcinol, 5-chloro 2,4-dihydroxydiphenyl methane, 4-chloro 2,4-dihydroxydiphenyl methane, 5-bromo 2,4-dihydroxydiphenyl methane, and 4-bromo 2,4-dihydroxydiphenyl methane, bisphenolic compounds like 2,2-methylene bis(4-chlorophenol), 2,2-methylene bis(3,4,6-trichlorophenol), 2,2-methylene bis(4-chloro-6-bromophenol), bis(2-hydroxy-3,5-dichlorophenyl) sulphide, and bis(2-hydroxy-5-chlorobenzyl)sulphide, benzoic esters (parabens) like methylparaben, propylparaben, butylparaben, ethylparaben, isopropylparaben, isobutylparaben, benzylparaben, sodium methylparaben, and sodium propylparaben, halogenated carbanilides (e.g., 3,4,4-trichlorocarbanilides (Triclocarban or TCC), 3-trifluoromethyl-4,4-dichlorocarbanilide, 3,3,4-trichlorocarbanilide, etc.). The phenol based anti-microbials are advantageously used.

Exemplary pH-adjusting agents include one or more agents selected from the group consisting of a hydroxide, a hydroxide generator, a buffer, and a mixture of same. Such pH-adjusting agents include alkali metal salts of various inorganic acids, such as alkali metal phosphates, polyphosphates, pyrophosphates, triphosphates, tetraphosphates, silicates, metasilicates, polysilicates, borates, carbonates, bicarbonates, hydroxides, and mixtures of same; preferred pH-adjusting agents are alkali metal hydroxides.

Further pH-adjusting agents include one or more organic or inorganic acids. Exemplary acids include one or more of sulphuric acid, hydrochloric acid, phosphoric acid, nitric acid, boric acid, formic acid, acetic acid, malic acid, maleic acid, succinic acid, tartaric acid, lacetic acid, glutaric acid, glycolic acid, fumaric acid, benzoic acid, citric acid, sulphamic acid, oxalic acid, and mixtures thereof.

A liquid cleaning composition may also include one or more alkanolamines which improve the cleaning of greasy soils, including one or more of: monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. Such alkanolamines may also function as pH adjusting agents/pH buffers.

The liquid cleaning composition may include a viscosity modifier, e.g., a thickener which increases the viscosity of the cleaning composition. Such may be desired if a more viscous cleaning composition is desired for use with the article of the invention. Exemplary useful viscosity modifiers include polysaccharide polymers e.g., cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses as well as other modified celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

One or more of these optional constituents may be included in the liquid cleaning composition, and each included optional constituent may be included in any effective amount. Preferably the total amount of optional constituents present do not exceed 25 percent weight, preferably do not exceed 10 percent weight of the liquid cleaning composition of which they form a part.

The invention will now be further described, by way of example, with reference to the accompanying examples.

EXAMPLE 1

This example employs a trigger spray device which contains a liquid cleaning composition.

The liquid cleaning composition of this example is as follows:

| | |
|---|---|
| Hydrogen peroxide | 8% |
| Citric acid to pH 4 | 2% |
| Nonyl phenol ethoxylate | 2% |
| Fragrance | 0.2% |
| Deionised water | to 100% |

The trigger spray device is modified from a conventional device, so as to include a solid state catalyst which the hydrogen peroxide solution exiting the trigger spray device contacts. Thus, the plastic parts which constitute the conventional swirl chamber, adjacent to the exit nozzle of the trigger spray device, carry a solid state catalyst which promotes the decomposition of the hydrogen peroxide. In this embodiment the solid state catalyst is manganese dioxide. Manganese dioxide in powder form is adhesively secured to the surfaces of the flow pathway within the swirl chamber.

When the device is used the liquid cleaning composition is brought into contact with the solid state catalyst and a catalytic reaction is initiated. This causes the breakdown of a hydrogen peroxide, releasing active oxygen species [O], and heat; both of which may improve cleaning of soils on hard surfaces or fabrics.

EXAMPLE 2

This example employs a marker-pen type device which contains the liquid cleaning composition of Example 1.

The device has a reservoir for the liquid cleaning composition, and an applicator head in the form of a compressed fibre block. Particles of manganese dioxide are adhered to the fibres of the fibre block.

The device is stored with the applicator head upright. In use the device is inverted and the liquid chemical composition flows into the applicator head, and the chemical reaction commences. When use is completed the device is once again stored with the applicator head upright. The liquid chemical composition will not flow back into the reservoir due to the capillary structure of the applicator head. The liquid chemical composition still inside the reservoir is therefore not degraded by the solid state catalyst.

This device is useful for localised application of the liquid chemical composition to soils on fabrics; for example to grime marks on collars and cuffs, as a pre-treatment prior to washing.

EXAMPLE 3

This example employs a sponge-type device which contains the liquid cleaning composition of Example 1.

The device has a squeezable reservoir for the liquid cleaning composition, and an applicator head in the form of a closed-cell polyurethane sponge. The sponge is formed of a first portion impregnated with particles of manganese dioxide by addition thereof during the foam-forming process; and a second portion, not impregnated with any manganese dioxide. The first and second portions are secured together, for example by adhesive. The first and second portions of the sponge are pieced by a plurality of through-bores. The first portion is the portion which contacts a body to be cleaned.

In this embodiment the liquid chemical composition only flows through the pores when the reservoir is squeezed. When this happens the chemical reaction commences when the liquid chemical composition reaches the first portion. When use is completed the device is once again stored and there is no tendency for the liquid chemical composition to flow back into the reservoir.

This device is useful for localised application of the liquid chemical composition to soils on footwear, in particular trainers.

EXAMPLE 4

This example employs a catalytic cleaning cloth and a separate container which contains a liquid cleaning composition. The cloth and container are packaged together.

The liquid cleaning composition of this example is as follows:

| | |
|---|---|
| Hydrogen peroxide | 7% |
| Citric acid to pH 4 | 2.5% |
| Nonyl phenol ethoxylate | 1% |
| Fragrance | 0.2% |
| Deionised water | to 100% |

The liquid cleaning composition is contained within an entirely conventional trigger spray device.

The catalytic cleaning cloth is of non-woven form. Adhered to or grafted to fibres of the cloth may be any catalyst which destabilises hydrogen peroxide to release active oxygen species.

When the device is used the liquid cleaning composition is sprayed onto a body to be cleaned and the cleaning cloth is used to wipe the composition over the surface. In this manner there is contact between the liquid cleaning composition and the solid state catalyst and a catalytic reaction is initiated. This causes the breakdown of a hydrogen peroxide, releasing active oxygen species [O], and heat; both of which may improve cleaning of the surface.

EXAMPLE 5

This example employs a roller ball device which contains the liquid cleaning composition of Example 1.

The roller ball device differs from a conventional roller ball applicator, in that the roller ball is a moulded plastics/catalyst (e.g. manganese dioxide) compound; in that the reservoir of liquid cleaning composition is kept isolated from the solid state catalyst until it is expelled from the device; and optionally in that the reservoir may be compressed by squeezing.

The device has an isolation chamber, in communication with the roller ball. The isolation chamber is only intermittently in communication with the reservoir, via a silicone valve of the sphincter type, opening under fluid pressure. The action of inverting the device (or squeezing the reservoir, when the reservoir may be compressed by squeezing) causes a portion of the liquid cleaning composition to bleed through the valve and into the isolation chamber. The catalytic action commences when the liquid cleaning composition comes into contact with the catalytic roller ball. There may be some catalytic action in the isolation chamber but in many situations the action of using the roller ball to deliver the liquid chemical composition onto a body is the major source of catalytic action.

The device is intended for cleaning marks on garments, in particular grime marks on collars and cuffs. In use the catalytic reaction causes the breakdown of a hydrogen peroxide, releasing active oxygen species [O], and heat.

EXAMPLE 6

This example employs a trigger spray device which contains a liquid cleaning composition.

The liquid cleaning composition of this example is as follows:

| | |
|---|---|
| Sodium hypochlorite | 5.25% |
| Nonyl phenol ethoxylate | 2% |
| MANUCOL ester (Trade Mark) (propylene glycol alginate, available from International Speciality Products | 1% |
| Fragrance | 0.2% |
| Deionised water | to 100% |

The trigger spray device is modified from a conventional device, so as to include a solid state catalyst which the sodium hypochlorite solution exiting the trigger spray device contacts. Thus, a fine grid is provided at the outlet of the trigger spray device, through which the sodium hypochorite exits. The grid is moulded from a compound of a plastics material and cobalt (III) nitrate, in a loading of 5 p/w of cobalt (III) nitrate to 95 p/w of plastics material.

When the device is used the liquid cleaning composition passes through the grid and in so doing is in intimate contact with it. Catalytic cobalt (III) nitrate species are inevitably at the surface of the grid and are in contact with the liquid cleaning composition, and initiate the catalytic decomposition of the sodium hypochlorite, yielding bleaching species and oxygen gas. The oxygen gas promotes the formation of a foam, this also being assisted by the grid.

This example may be particularly useful in the cleaning of sanitaryware articles, such as toilet bowls.

EXAMPLE 7

This example employs a device for use in a fabric washing machine.

The liquid cleaning composition is the washing liquor, produced by dispersion and/or dissolution of a washing powder. The washing liquor contains sodium percarbonate, in addition to conventional washing aids, including anionic surfactants.

Pills (of size similar to pharmaceutical tablets) of co-moulded plastics and manganese dioxide powder (95:5, weight: weight) are manufactured. Twelve pills are held captive in a plastics cage, into and through which the wash liquor can flow. The catalyst activates the percarbonate ions in the wash liquor, and improves the washing efficacy.

The invention claimed is:

1. A cleaning combination comprising a liquid cleaning composition and a solid state catalyst separate from the liquid cleaning composition, the liquid cleaning composition comprising a bleaching agent and one or more organic or inorganic acids, the solid state catalyst is selected from a group consisting of a copper salt, a cobalt salt, a transition metal and a transition metal compound, the solid state catalyst causing a chemical reaction in the liquid cleaning composition when the liquid cleaning composition is brought into contact with the solid state catalyst, and further comprising a container for the liquid cleaning composition, wherein the container contains the solid state catalyst in such a manner that the liquid cleaning composition is only in contact with the solid state catalyst during exiting of the liquid cleaning composition from the container.

2. A cleaning combination according to claim 1, wherein the solid state catalyst is comprised by a non-particulate body.

3. A cleaning combination according to claim 1, wherein the container is a trigger spray device and the solid state catalyst is located in the outflow part thereof.

4. A cleaning combination according to claim 1, wherein the container has an applicator part adapted to deliver the liquid cleaning composition to a substrate to be cleaned whilst in contact therewith, the solid state catalyst being comprised by or otherwise being in the region of the applicator part.

5. A cleaning combination according to claim 1, wherein the solid state catalyst is comprised by a part which is brought into contact with the liquid cleaning composition during the actual cleaning, subsequent to the delivery of the liquid cleaning composition to the cleaning locus.

6. A cleaning combination according to claim 5, wherein the part is a cleaning article.

7. A cleaning combination according to claim 5, wherein the solid state catalyst is comprised by a part which is ordinarily present at the cleaning locus.

8. A cleaning combination according to claim 1, wherein the catalyst when contacted by the liquid cleaning composition starts a chemical reaction which can proceed in the absence of the solid state catalyst.

9. A cleaning combination according to claim 1, wherein the chemical reaction is a decomposition of a compound within the liquid cleaning composition.

10. A cleaning combination according to claim 1, wherein the chemical reaction is the reaction between a component of the liquid cleaning composition and a compound present in the cleaning environment.

11. A cleaning combination according to claim 1, wherein the chemical reaction is the reaction between a component of the liquid cleaning composition and a component of a second liquid cleaning composition of the cleaning combination, the second liquid cleaning composition being kept separate from the first liquid cleaning composition in the cleaning combination, the reaction being assisted by the solid state catalyst.

12. A cleaning combination according to claim 1, wherein the chemical reaction is to release a bleaching agent.

13. A cleaning combination according to claim 12, wherein the liquid cleaning composition comprises a peroxygen compound, the solid state catalyst causing the release of active oxygen species in the liquid cleaning composition when the liquid cleaning composition is brought into contact with the solid state catalyst.

14. A cleaning combination according to claim 1, wherein the chemical reaction causes a colour change.

15. A cleaning combination according to claim 1, wherein the chemical reaction causes a change of pH.

16. A cleaning combination according to claim 1, wherein the chemical reaction causes gas evolution.

17. A cleaning combination according to claim 16, wherein the chemical reaction causes foaming.

18. A cleaning combination according to claim 1, wherein the chemical reaction causes the evolution of heat.

19. A cleaning combination according to claim 1, wherein the liquid cleaning composition, and the solid state catalyst are comprised with the same device.

20. A cleaning combination according to claim 1, wherein the solid state catalyst is retained in a fixed position within the container.

21. A cleaning device comprising a container of a liquid cleaning composition and a solid state catalyst separate from the liquid cleaning composition, the solid state catalyst causing a chemical reaction in the liquid cleaning composition when the liquid cleaning composition and solid state catalyst are in contact with each other, the liquid cleaning composition comprising a bleaching agent and one or more organic or inorganic acids, the solid state catalyst is selected from a group consisting of a copper salt, a cobalt salt, a transition metal and a transition metal compound, wherein the liquid cleaning composition contacts the solid state catalyst only during exiting of the liquid cleaning composition from the device, wherein the container contains the solid state catalyst in such a manner that the liquid cleaning composition is only in contact with the solid state catalyst during exiting of the liquid cleaning composition from the container.

22. A body comprising a solid state catalyst, the solid state catalyst is separate from a liquid cleaning composition in a container and is capable of causing a chemical reaction in the liquid cleaning composition when the liquid cleaning composition is in contact with it, the liquid cleaning composition comprising a bleaching agent and one or more organic or inorganic acids, the solid state catalyst is selected from a group consisting of a copper salt, a cobalt salt, a transition metal and a transition metal compound, wherein the container contains the solid state catalyst in such a manner that the liquid cleaning composition is only in contact with the solid state catalyst during exiting of the liquid cleaning composition from the container.

23. A method of chemically modifying a liquid cleaning composition by contacting it during cleaning with a body according to claim 22.

24. A method of cleaning comprising delivering a liquid cleaning composition to a locus to be cleaned, wherein the liquid cleaning composition contacts a body according to claim 22 during the method.

25. A cleaning combination comprising a liquid cleaning composition and a solid state catalyst separate from the liquid cleaning composition, the liquid cleaning composition comprising a bleaching agent and one or more organic or inorganic acids, the solid state catalyst is selected from a group consisting of a copper salt, a cobalt salt, a transition metal and a transition metal compound, the solid state catalyst causing a chemical reaction in the liquid cleaning composition when the liquid cleaning composition is brought into contact with the solid state catalyst, and further comprising a container for the liquid cleaning composition, wherein the container contains the solid state catalyst downstream from the liquid cleaning composition in such a manner that the liquid cleaning composition is only in contact with the solid state catalyst, by flowing over or through the solid state catalyst, during exiting of the liquid cleaning composition from the container.

26. A cleaning combination according to claim 25, wherein the solid state catalyst is comprised by a non-particulate body.

27. A cleaning combination according to claim 25, wherein the container has an applicator part adapted to deliver the liquid cleaning composition to a substrate to be cleaned whilst in contact therewith, the solid state catalyst being comprised by or otherwise being in the region of the applicator part.

28. A cleaning combination according to claim 25, wherein the catalyst when contacted by the liquid cleaning composition starts a chemical reaction which can proceed in the absence of the solid state catalyst.

29. A cleaning combination according to claim 25, wherein the chemical reaction is a decomposition of a compound within the liquid cleaning composition.

30. A cleaning combination according to claim 25, wherein the chemical reaction is the reaction between a component of the liquid cleaning composition and a compound present in the cleaning environment.

31. A cleaning combination according to claim 25, wherein the chemical reaction is the reaction between a component of the liquid cleaning composition and a component of a second liquid cleaning composition of the cleaning combination, the second liquid cleaning composition being kept separate from the first liquid cleaning composition in the cleaning combination, the reaction being assisted by the solid state catalyst.

32. A cleaning combination according to claim 25, wherein the liquid cleaning composition, and the solid state catalyst are comprised wit the same device.

* * * * *